US007721533B2

(12) United States Patent
Imoehl et al.

(10) Patent No.: US 7,721,533 B2
(45) Date of Patent: May 25, 2010

(54) DIESEL DOSING SYSTEM RELIEF OF TRAPPED VOLUME FLUID PRESSURE AT SHUTDOWN

(75) Inventors: William Imoehl, Williamsburg, VA (US); Willem Nicolaas van Vuuren, Yorktown, VA (US)

(73) Assignee: Continental Automotive Systems US, Inc., Auburn Hills ( * ) Notice: Subject to any disclaimer, the term of this patent is extended or adjusted under 35 U.S.C. 154(b) by 119 days.

(21) Appl. No.: 12/081,537

(22) Filed: Apr. 17, 2008

(65) Prior Publication Data

US 2008/0282679 A1 Nov. 20, 2008

Related U.S. Application Data

(60) Provisional application No. 60/938,033, filed on May 15, 2007.

(51) Int. Cl.
*F01N 3/00* (2006.01)

(52) U.S. Cl. ..... 60/286; 60/274; 60/295; 60/301; 60/303

(58) Field of Classification Search ..... 60/274, 60/286, 295, 301, 303
See application file for complete search history.

(56) References Cited

U.S. PATENT DOCUMENTS

| | | | | |
|---|---|---|---|---|
| 5,884,475 | A * | 3/1999 | Hofmann et al. | 60/274 |
| 6,063,350 | A * | 5/2000 | Tarabulski et al. | 423/239.1 |
| 6,685,112 | B1 | 2/2004 | Hornby et al. | |
| 7,017,335 | B2 * | 3/2006 | Huber et al. | 60/286 |
| 7,594,393 | B2 * | 9/2009 | Offenhuber et al. | 60/286 |
| 2007/0227127 | A1 | 10/2007 | Hornby | |

* cited by examiner

*Primary Examiner*—Thomas E Denion
*Assistant Examiner*—Diem Tran

(57) ABSTRACT

A diesel dosing system for a vehicle includes a control valve (31) controlling fluid flow to a dosing valve (32) for supplying fuel directly into an exhaust passage of the vehicle. A system pressure source (55) feeds the control valve. A shutoff valve (54) is fluidly connected to the pressure source downstream thereof and to the control valve upstream thereof. The shutoff valve permits bidirectional flow there-through. A connection (57) is between the shutoff valve and the control valve defining a fluid volume there-between. The shutoff valve permits fluid flow from the system pressure source through the connection and to the control valve during a regeneration phase of the system. Upon engine shutdown and based on fluid pressure in the volume, the shutoff valve opens so that fluid trapped in the volume will communicate with the pressure source thereby reducing the fluid pressure in the volume.

20 Claims, 3 Drawing Sheets

DIESEL DOSING SYSTEM RELIEF OF TRAPPED VOLUME FLUID PRESSURE AT SHUTDOWN

This application claims the priority benefit of the earlier filing date of U.S. Provisional Application No. 60/938,033, filed on May 15, 2007, which is incorporated by reference herein in its entirety.

FIELD OF THE INVENTION

This invention relates to reducing and trapping diesel particulates of a diesel engine for vehicles and, more particularly to preventing excessive buildup of fluid pressure during hot shutdown in a diesel dosing system (DDS).

BACKGROUND OF THE INVENTION

The advent of a new round of stringent emissions legislation in Europe and North America is driving the implementation of new exhaust aftertreatment systems, particularly for compression-ignition (diesel) engines that exhibit high levels of soot and particulate matter in the engine exhaust. Exhaust aftertreatment technologies are currently in production that trap these particulate emissions. These diesel particulate filters (DPFs) require periodic regeneration to remove the built-up particulate matter (PM). The regeneration requires temperatures in excess of 540 C. to efficiently oxidize the PM and clean out the filter. These temperatures are rarely achieved under normal operation in many diesel applications; therefore, an active regeneration approach is often required to guarantee periodic cleaning of the DPF.

Generally, the active regeneration is achieved by a post-injection of the main engine fuel injectors (injection of fuel during the exhaust stroke). The extra, uncombusted fuel enters the exhaust system where it oxidizes and thereby increases the exhaust gas temperature to the required levels for regeneration.

Improvements to this approach have been developed, notably, diesel dosing systems that inject hydrocarbons directly into the exhaust system.

There is a need to further improve a diesel dosing system to prevent excessive build-up of fluid pressure during hot shutdown.

SUMMARY OF THE INVENTION

An object of the invention is to fulfill the need referred to above. In accordance with the principles of the present invention, this objective is achieved by providing a diesel dosing system for a vehicle. The dosing system includes a control valve controlling fluid flow to a dosing valve. The dosing valve is constructed and arranged to supply fuel directly into an exhaust passage of the vehicle. A system pressure source feeds the control valve. A shutoff valve is fluidly connected to the pressure source downstream thereof and to the control valve upstream thereof, the shutoff valve permitting bi-directional flow there-through. A connection is provided between the shutoff valve and the control valve defining a fluid volume there-between. The shutoff valve is constructed and arranged to permit fluid flow from the system pressure source through the connection and to the control valve during a regeneration phase of the system. Upon engine shutdown and based on fluid pressure in the volume, the shutoff valve is constructed and arranged to open so that fluid trapped in the volume will communicate with the pressure source thereby reducing the fluid pressure in the volume.

In accordance with another aspect of the invention, a method of controlling pressure in a diesel dosing system for a vehicle provides a diesel dosing system including a control valve controlling fluid flow to a dosing valve. The dosing valve is constructed and arranged to supply fuel directly into an exhaust passage of the vehicle. The system includes a system pressure source feeding the control valve; a shutoff valve fluidly connected to the pressure source downstream thereof and to the control valve upstream thereof, the shutoff valve permitting bidirectional flow there-through; and a connection between the shutoff valve and the control valve defining a fluid volume there-between, the shutoff valve permitting fluid flow from the system pressure source through the connection and to the control valve during a regeneration phase of the system. Under engine shutdown conditions and under certain fluid pressure in the volume the method permits the shutoff valve to open so that fluid trapped in the volume will communicate with the pressure source thereby reducing the fluid pressure in the volume.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
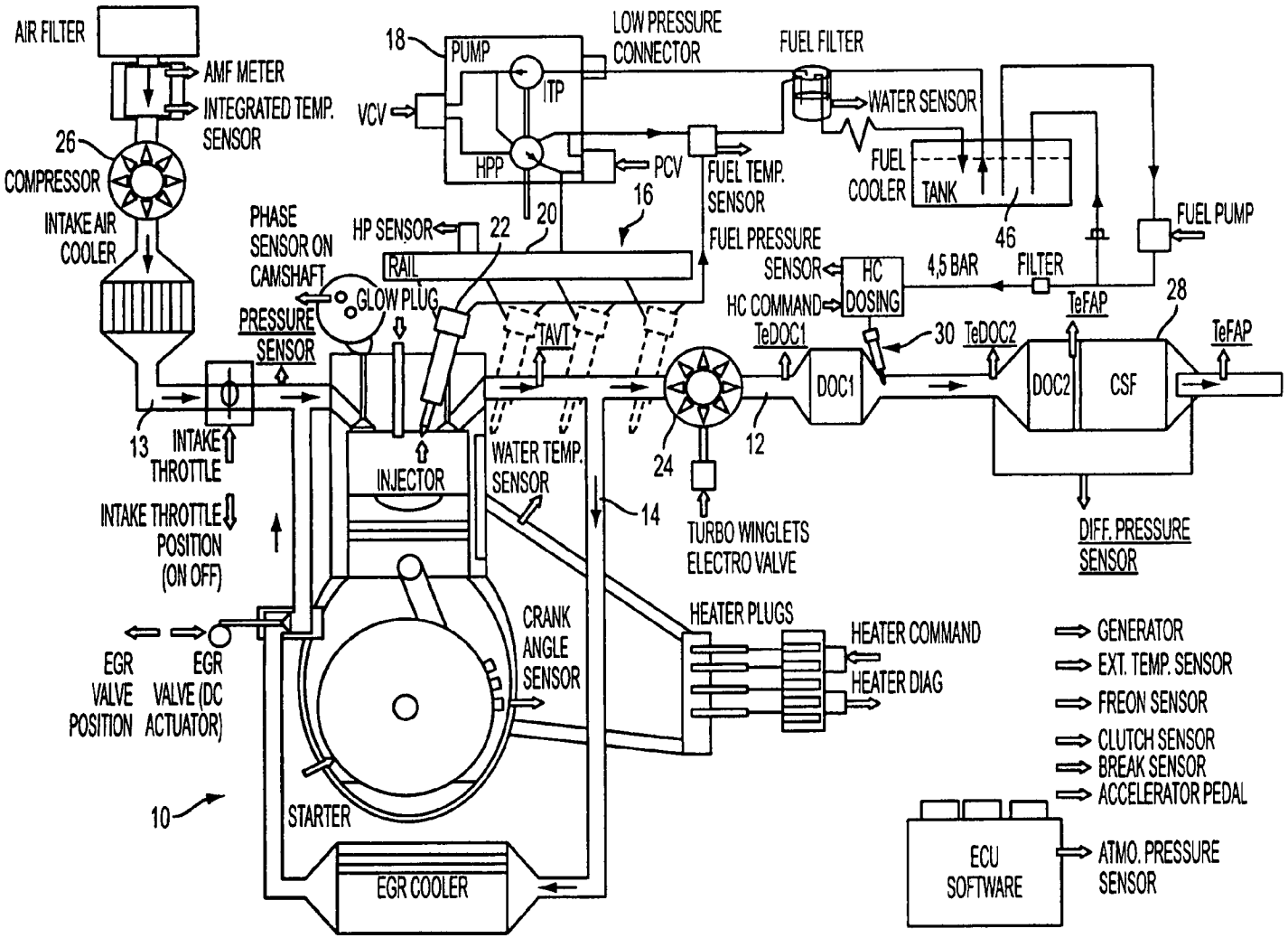
FIG. 1 is a schematic diagram of an exhaust gas purifying system including a diesel dosing structure in accordance with an embodiment of the present invention.

Referring to FIG. 1 of the drawings, a multi-cylinder diesel engine, generally indicated at 10, for vehicles is provided with an exhaust passage 12 and intake passage 13. The intake passage 13 distributes intake air to each cylinder. The exhaust passage 12 and the intake passage 13 are connected by an exhaust gas recirculation (EGR) passage 14 in the conventional manner.

The engine 10 is provided with a common rail fuel injection device, generally indicated at 16. The fuel injection device 16 is provided with a supply pump 18, common rail 20 and an injector 22 provided for every cylinder. Fuel pressurized by the supply pump 18 is distributed to each injector 22 via the common rail 20.

A variable capacity turbocharger 24 is provided in the exhaust passage 12 downstream of the EGR passage 14. Compressor 26, installed in the intake passage 13, can be considered to be part of the turbocharger 24. A turbine (not shown) of the turbocharger 24 transforms the energy of the flow of exhaust gas into rotational energy, and can drive the compressor 26 using this rotational energy.

A diesel particulate filter (DPF) 28 which traps particulate matter in the exhaust gas is installed in the exhaust passage 12 downstream of the turbine 24. Diesel fuel burns off the particulates trapped in the filter, thus regenerating particulate storage capacity.

Figure 2:
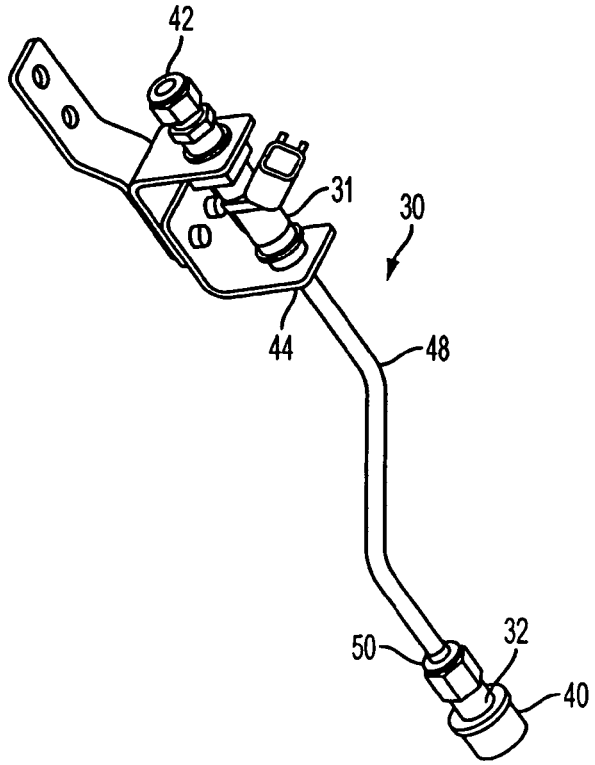
FIG. 2 is a view of the diesel dosing structure of FIG. 1.
Figure 3:
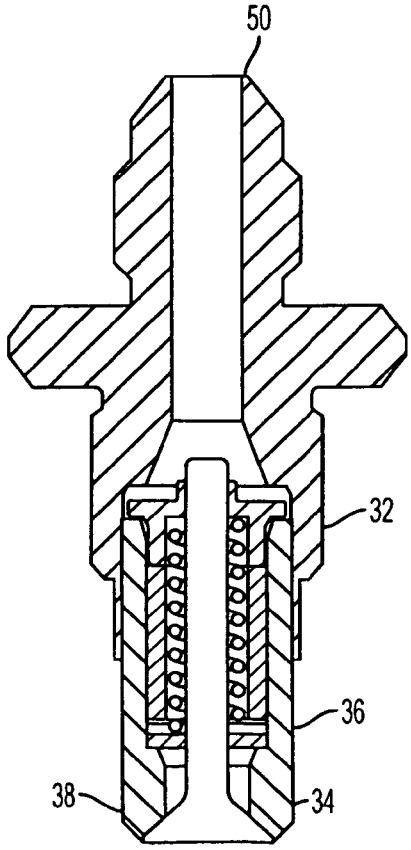
FIG. 3 is an enlarged sectional view of the dosing valve of FIG. 2.

As shown in FIG. 1, a dosing structure, generally indicated at 30, is provided in the exhaust passage 12 upstream of the filter 28. With reference to FIG. 2, the dosing structure 30 includes a control valve 31, a dosing valve 32 and an extension tube 48 there-between. The dosing valve 32 is preferably in the form of a poppet valve. As shown in FIG. 3, the poppet valve 32 has a valve member 34 that extends outwardly from a body 36 of the valve 31 when in the opened position, permitting fuel to flow into the exhaust passage 12. End 38 is inserted (e.g., threaded) into the exhaust manifold 40 (see FIG. 2). The poppet valve 32 preferably has all metal construction (e.g., stainless steel), capable of withstanding the high temperature of the manifold 40. The poppet valve 32 is constructed and arranged to create a particular spray configuration into the exhaust passage 12.

The control valve 31 is preferably a gasoline, solenoid operated fuel injector without a precision orifice. Since there is no need for special spray patterns from the injector, a simple pencil stream is sufficient. A suitable injector can be of the type disclosed in U.S. Pat. No. 6,685,112, the content of which is hereby incorporated by reference into this specification. The control valve 31 has a fuel inlet 42 and a fuel outlet 44. The inlet 42 receives diesel fuel from the tank 46 (FIG. 1). The fuel outlet 44 is connected with one end of the extension tube 48, with another end of the extension tube being connected with an inlet 50 of the dosing valve 32. The control valve 31 controls the flow rate to the dosing valve 32 and also shuts-off the flow.

Figure 4:
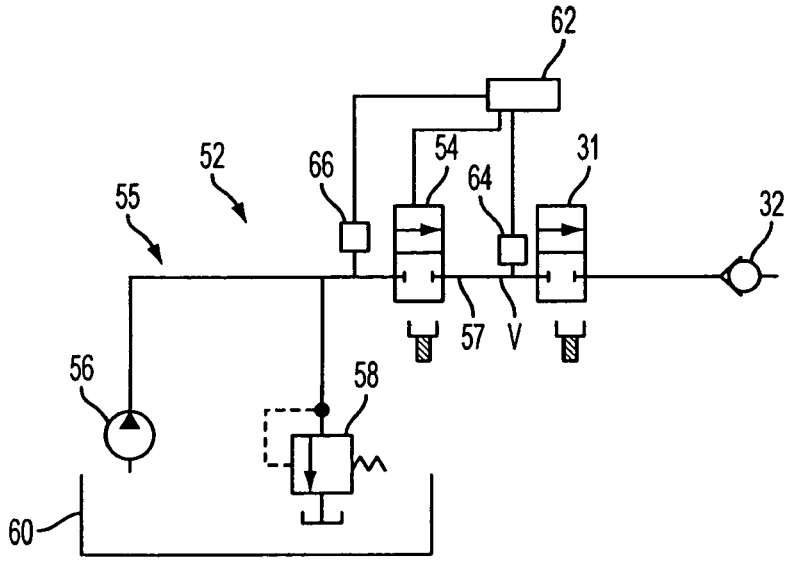
FIG. 4 is schematic view of a DDS fluid supply system in accordance with an embodiment of the invention.

The extension tube 48 is of sufficient length to place the control valve 31 away from the heat of the manifold 40. The extension tube 48 can be a metal tube or can be a flexible tube such as a fiberglass braided Teflon hose, capable of withstanding 230 C. Utilization of the flexible extension tube allows for mounting the control valve 31 on a chassis and the dosing valve 32 on the exhaust. This configuration accommodates large amounts of displacement. In other applications, the control valve and the dosing valve are mounted on the engine, thus a metal extension tube can be used. All connections between the tube 48 and the valves 31 and 32 are preferably welded:

With reference to FIG. 4, another embodiment of a DDS is shown. The system, generally indicated at 52, includes an intermediate, electrically actuated, normally closed two-position, two-port valve 54 between the system pressure source, generally indicated at 55, and the control valve 31. Thus, the valve 54 is downstream of the pressure source 55 and upstream of the control valve 31. In the embodiment, the system pressure source 55 includes at least a fuel pump and tubing associated therewith, but can also include a regulator 58 associated with the fuel tank 60. A connection 57 that defines a fluid volume V is provided between the control valve 31 and the shutoff valve 54. The valve 54 is opened when the DDS enters the regeneration phase, and is closed when the DDS is not active.

A concern may arise upon shutdown of the vehicle. In particular, under hot conditions, the fluid in the trapped volume V between the control valve 31 and the shutoff valve 54 may expand, thereby increasing the fluid pressure in that zone to levels beyond the design capability of the tubing and hydraulic connections.

In accordance with an embodiment of the invention, a strategy for preventing excessive buildup of fluid pressure in volume V provides a controller 62 with sensor inputs permitting direct measure or indirect determination of fluid pressure in the trapped volume. This can be accomplished by sensor structure 64, associated with the trapped volume V, monitored by the controller 62. In the embodiment, the sensor structure 64 can be a fluid pressure sensor or a fluid temperature sensor. The controller 62 also can have information on the state of the supply system pressure upstream of the shutoff valve 54 provided by pressure or temperature sensor 66.

Figure 5:
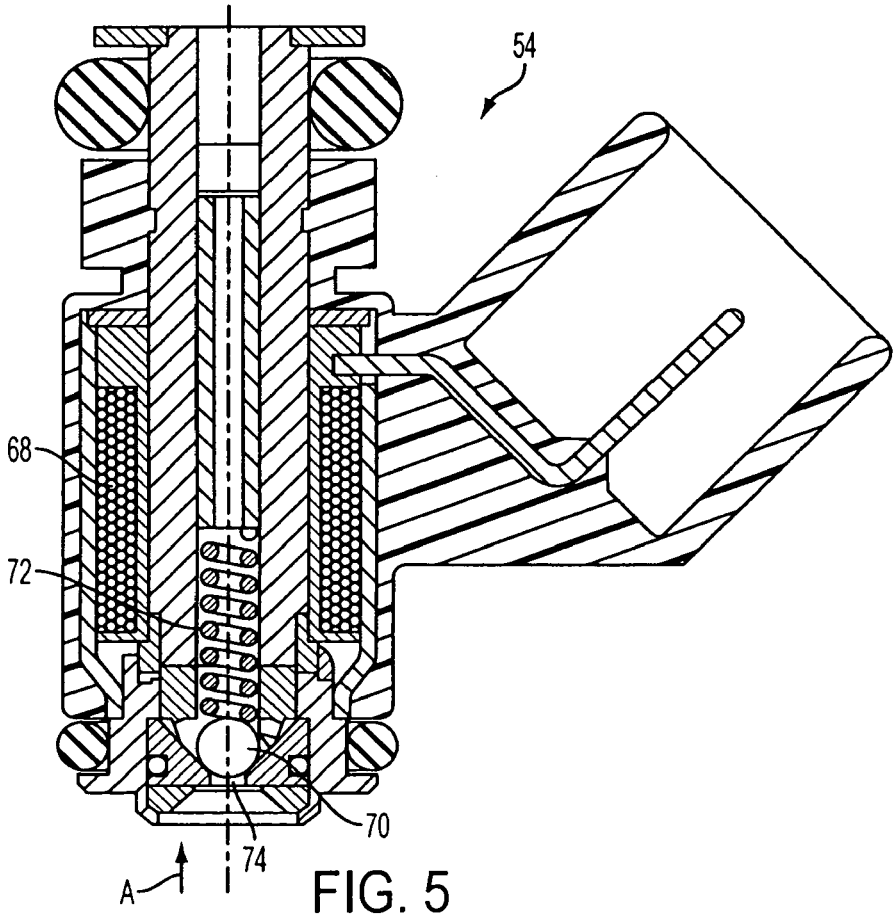
FIG. 5 is a sectional view of a shut-off valve in accordance with an embodiment of the invention.

With reference to FIG. 5, the shutoff valve 54 in the embodiment is preferably a gasoline port fuel injector or equivalent. The injector has a solenoid, generally indicated at 68, that when actuated, permits valve element 70, normally held closed by a spring 72, to open. A suitable injector can be of the type disclosed in U.S. Pat. No. 6,685,112. Flow through the injector can be bidirectional. The spring 72 exerts a force on the valve element 70 that can be overcome by sufficient levels of reverse direction (e.g., direction A) differential fluid pressure, resulting in an opening of the outlet 74 upon movement of the valve element 70.

In accordance with the embodiment, a control strategy becomes active under engine shutdown conditions, with the shutoff valve 54 opening for a finite period of time determined by the calibration of the controller 62. The controller 62 thus can cause the shutoff valve 54 to open at the appropriate pressure. The opening of the shutoff valve 54 at shutdown puts the trapped volume V in fluid communication with the system pressure source 55, which in the embodiment has been depressurized. The depressurization can be either active, or passive in the case of a mechanical regulation with a known leakdown path. This action permits the flow of fluid out of the trapped volume V. The resulting reduced pressure would limit the risk of overpressurization due to expansion of the remaining fluid volume after closure of the shutoff valve 54. It is noted that this strategy can also be implemented at any time overpressure conditions are detected by the controller 62.

Instead of using the controller to open the shutoff valve 54 based on sensed pressure or temperature, the shutoff valve spring 72 can be configured to allow opening of the valve element 70 automatically at a defined pressure threshold. This pressure threshold is set at a level equal to or below the system design proof pressure, but above the normal operating pressure of the system. In this manner, it can be ensured that the trapped volume V will not be exposed to fluid pressures beyond the capability of the system.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A method of controlling pressure in a diesel dosing system for a vehicle, the method comprising:

providing a diesel dosing system including:

a control valve controlling fluid flow to a dosing valve, the dosing valve being coupled directly with an exhaust passage of the vehicle and having structure movable from a closed position to an open position to supply fuel directly into the exhaust passage, a system pressure source feeding the control valve, a shutoff valve fluidly connected to the pressure source downstream thereof and to the control valve upstream thereof, the shutoff valve permitting bi-directional flow there-through, and a connection between the shutoff valve and the control valve defining a fluid volume there-between, the shutoff valve permitting fluid flow from the system pressure source through the connection and to the control valve during a regeneration phase of the system, and under engine shutdown conditions and under certain fluid pressure in the volume, permitting the shutoff valve to open so that fluid trapped in the volume will communicate with the pressure source thereby reducing the fluid pressure in the volume, and when the shutoff valve is closed, ensuring that no fluid in the volume communicates with the pressure source.

2. The method of claim 1, further including determining the certain pressure in the volume by monitoring the volume with a sensor that is connected with a controller, the controller being connected with the shutoff valve, and wherein the permitting step includes actuating the shutoff valve with the controller.

3. The method of claim 2, wherein the sensor is one of a pressure or temperature sensor.

4. The method of claim 1, wherein the shutoff valve includes a spring biasing a valve element to a closed position, the method including configuring the spring to permit fluid pressure in the volume to overcome the bias of the spring at a certain fluid pressure, thereby opening the shutoff valve and permitting the fluid trapped in the volume to communicate with the pressure source.

5. The method of claim 4, wherein the certain pressure is greater than an operating pressure of the system.

6. The method of claim 1, wherein each of the shutoff valve and the control valve is a solenoid operated valve.

7. The method of claim 6, wherein the solenoid operated valve is a fuel injector.

8. A diesel dosing system for a vehicle, the diesel dosing system comprising:

a control valve controlling fluid flow to a dosing valve, the dosing valve being coupled directly with an exhaust passage of the vehicle and having structure movable from a closed position to an open position to supply fuel directly into the exhaust passage, a system pressure source feeding the control valve, a shutoff valve fluidly connected to the pressure source downstream thereof and to the control valve upstream thereof, the shutoff valve permitting bi-directional flow there-through, a connection between the shutoff valve and the control valve defining a fluid volume there-between, the shutoff valve being constructed and arranged to permit fluid flow from the system pressure source through the connection and to the control valve during a regeneration phase of the system, wherein upon engine shutdown and based on fluid pressure in the volume, the shutoff valve is constructed and arranged to open so that fluid trapped in the volume will communicate with the pressure source thereby reducing the fluid pressure in the volume, and wherein when the shutoff valve is closed, no fluid in the volume can communicate with the pressure source.

9. The system of claim 8, wherein the pressure source includes a fuel pump.

10. The system of claim 8, further comprising a sensor constructed and arranged to monitor the fluid pressure in the volume, and a controller, the sensor being connected with the controller, the controller being connected with the shutoff valve to open and close the shutoff valve.

11. The system of claim 10, wherein the sensor is one of a pressure or temperature sensor.

12. The system of claim 10, further comprising a second sensor constructed and arranged to monitor pressure between the pressure source and the shutoff valve, the second sensor being connected with the controller.

13. The system of claim 8, wherein the shutoff valve includes a spring biasing a valve element to a closed position, the spring being constructed and arranged to permit fluid pressure in the volume to overcome the bias of the spring at a certain fluid pressure, thereby opening the shutoff valve and permitting the fluid trapped in the volume to communicate with the pressure source.

14. The system of claim 13, wherein the certain pressure is greater than an operating pressure of the system.

15. The system of claim 8, wherein each of the shutoff valve and the control valve is a solenoid operated valve.

16. The system of claim 15, wherein the solenoid operated valve is a fuel injector.

17. A diesel dosing system for a vehicle, the diesel dosing system comprising:

a control valve controlling fluid flow to a dosing valve, the dosing valve being coupled directly with an exhaust passage of the vehicle and having structure movable from a closed position to an open position to supply fuel directly into the exhaust passage, a system pressure source feeding the control valve, means, fluidly connected to the pressure source downstream thereof and to the control valve upstream thereof, for permitting bi-directional flow there-through, a connection between the means for permitting bi-directional flow and the control valve defining a fluid volume there-between, the means for permitting bi-directional flow being constructed and arranged to permit fluid flow from the system pressure source through the connection and to the control valve during a regeneration phase of the system, wherein upon engine shutdown and based on fluid pressure in the volume, the means for permitting bi-directional flow is constructed and arranged to open so that fluid trapped in the volume will communicate with the pressure source thereby reducing the fluid pressure in the volume, and wherein when the shutoff valve is closed, no fluid in the volume can communicate with the pressure source.

18. The system of claim 17, further comprising a sensor constructed and arranged to monitor the fluid pressure in the volume, and a controller, the sensor being connected with the controller, the controller being connected with the means for permitting bi-directional flow to open and close the means for permitting bi-directional flow.

19. The system of claim 17, wherein means for permitting bi-directional flow is a solenoid operated valve.

20. The system of claim 17, wherein the means for permitting bidirectional flow is a valve including a spring biasing a valve element to a closed position, the spring being constructed and arranged to permit fluid pressure in the volume to overcome the bias of the spring at a certain fluid pressure, thereby permitting the valve element to move to an open position and permit the fluid trapped in the volume to communicate with the pressure source.

* * * * *